US006487802B2

(12) United States Patent
Suen

(10) Patent No.: US 6,487,802 B2
(45) Date of Patent: Dec. 3, 2002

(54) PHOTOLUMINESCENT EVACUATION ROUTE KIT

(76) Inventor: Peter H. K. Suen, 1, Clark Ave. PH12, Thornhill, Ontario (CA), L4J 7Y6

( * ) Notice: Subject to any disclaimer, the term of this patent is extended or adjusted under 35 U.S.C. 154(b) by 95 days.

(21) Appl. No.: 09/783,015

(22) Filed: Feb. 15, 2001

(65) Prior Publication Data

US 2002/0108283 A1 Aug. 15, 2002

(51) Int. Cl.[7] ..... G09F 13/20; A47G 1/06

(52) U.S. Cl. ..... 40/542; 40/716; 40/757; 40/766

(58) Field of Search ..... 40/542, 716, 765, 40/766, 768, 209, 649, 775, 776, 780, 757

(56) References Cited

U.S. PATENT DOCUMENTS 831,591 A * 9/1906 Aylsworth ..... 40/542
2,259,272 A * 10/1941 Sholkin et al. ..... 40/766 X
4,095,361 A * 6/1978 Ledenican ..... 40/766
4,729,183 A * 3/1988 Tarter et al. ..... 40/766
5,257,785 A * 11/1993 Sugie ..... 40/542 X
5,335,434 A * 8/1994 Shultz ..... 40/746 X

FOREIGN PATENT DOCUMENTS

FR 2308155 * 4/1975 ..... 40/542

* cited by examiner

*Primary Examiner*—Brian K. Green
(74) *Attorney, Agent, or Firm*—Varndell & Varndell, PLLC

(57) ABSTRACT

A photoluminescent evacuation route kit includes a U-shaped base frame for mounting on a wall surface or door panel by screws, the base frame defining a mounting groove, a mylar transparency of custom graphics sandwiched in between a photoluminescent back drop and a clear protective lens and inserted with the photoluminescent back drop and the clear protective lens into the mounting groove of the base frame, and a top frame detachably fastened to the base frame by screws to hold the mylar transparency, the photoluminescent back drop and the clear protective lens in the mounting groove of the base frame.

3 Claims, 3 Drawing Sheets

PHOTOLUMINESCENT EVACUATION ROUTE KIT

BACKGROUND OF THE INVENTION

The present invention relates to an evacuation route kit and, more particularly to a detachable photoluminescent evacuation route kit.

In hotels or public places, emergency evacuation route devices are provided to indicate the way to evacuate in case of fire. However, regular emergency evacuation route devices for this purpose do not have back light means. The graphics of emergency evacuation route of these emergency evacuation route devices cannot be seen in the dark. Further, an emergency evacuation route device must be made detachable so that the graphics of emergency evacuation route can easily be changed.

SUMMARY OF THE INVENTION

It is one object of the present invention to provide a photoluminescent evacuation route kit, which is detachable so that the user can change the graphics of emergency evacuation route easily. It is another object of the present invention to provide a photoluminescent evacuation route kit, which gives illumination to the graphics of emergency evacuation route in the dark. To achieve these and other objects of the present invention, a photoluminescent evacuation route kit is provided comprising a U-shaped base frame for mounting on a wall surface or door panel by screws, the base frame defining a mounting groove, a mylar transparency of custom graphics sandwiched in between a photoluminescent back drop and a clear protective lens and inserted with the photoluminescent back drop and the clear protective lens into the mounting groove of the base frame, and a top frame detachably fastened to the base frame by screws to hold the mylar transparency, the photoluminescent back drop and the clear protective lens in the mounting groove of the base frame. The photoluminescent backdrop gives illumination to the graphics of the mylar transparency in the dark. Further, after removal of screws from the top frame, the mylar transparency can be taken away for a replacement.

DETAILED DESCRIPTION OF THE PREFERRED EMBODIMENT

Figure 1:
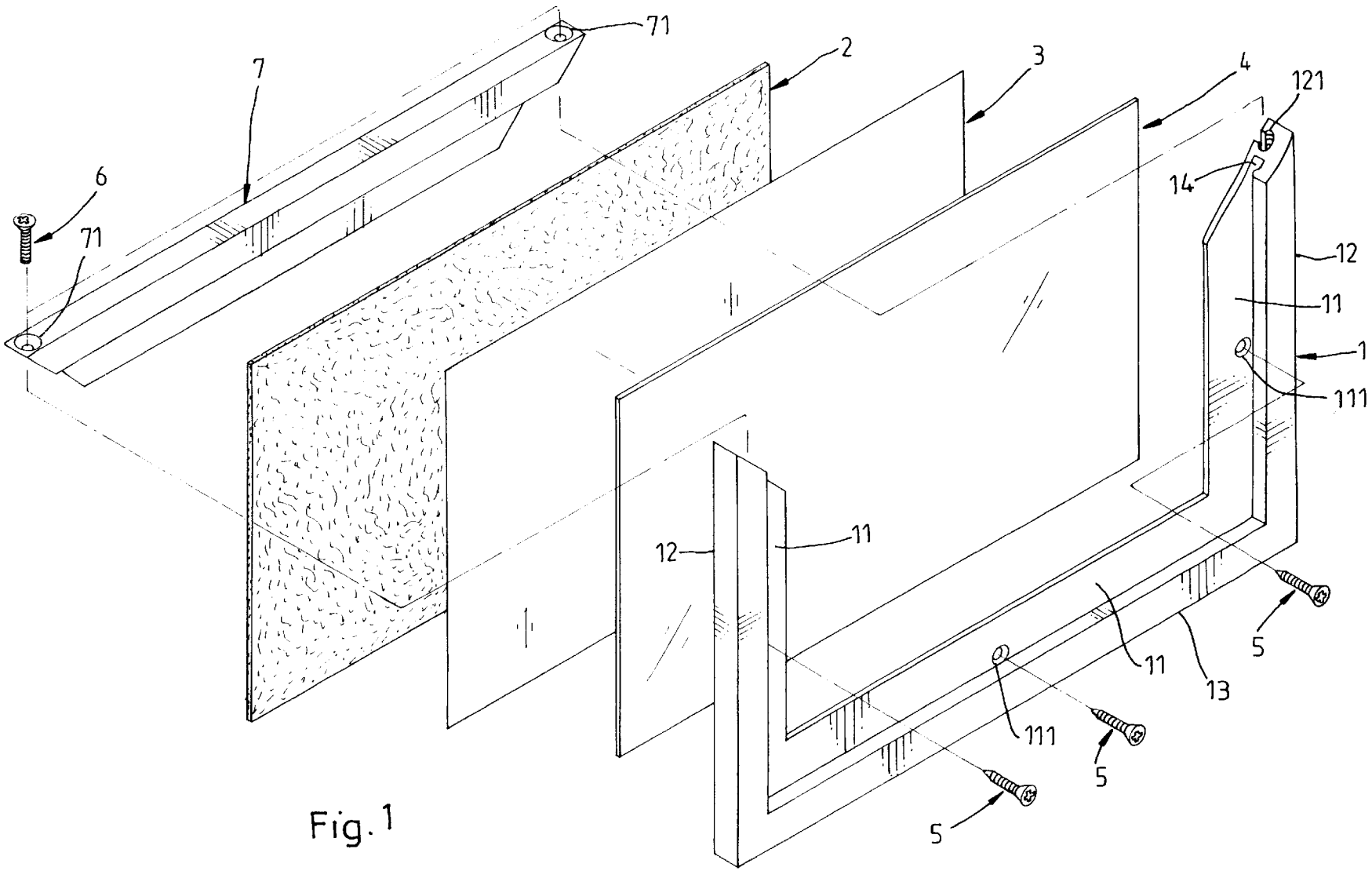
FIG. 1 is an exploded view of a photoluminescent evacuation route kit according to then present invention.

Referring to FIG. 1, a photoluminescent evacuation route kit in accordance with the present invention is generally comprised of a substantially U-shaped base frame 1, a photoluminescent back drop 2, a mylar transparency 3, a clear protective lens 4, and a top frame 7.

Figure 2:
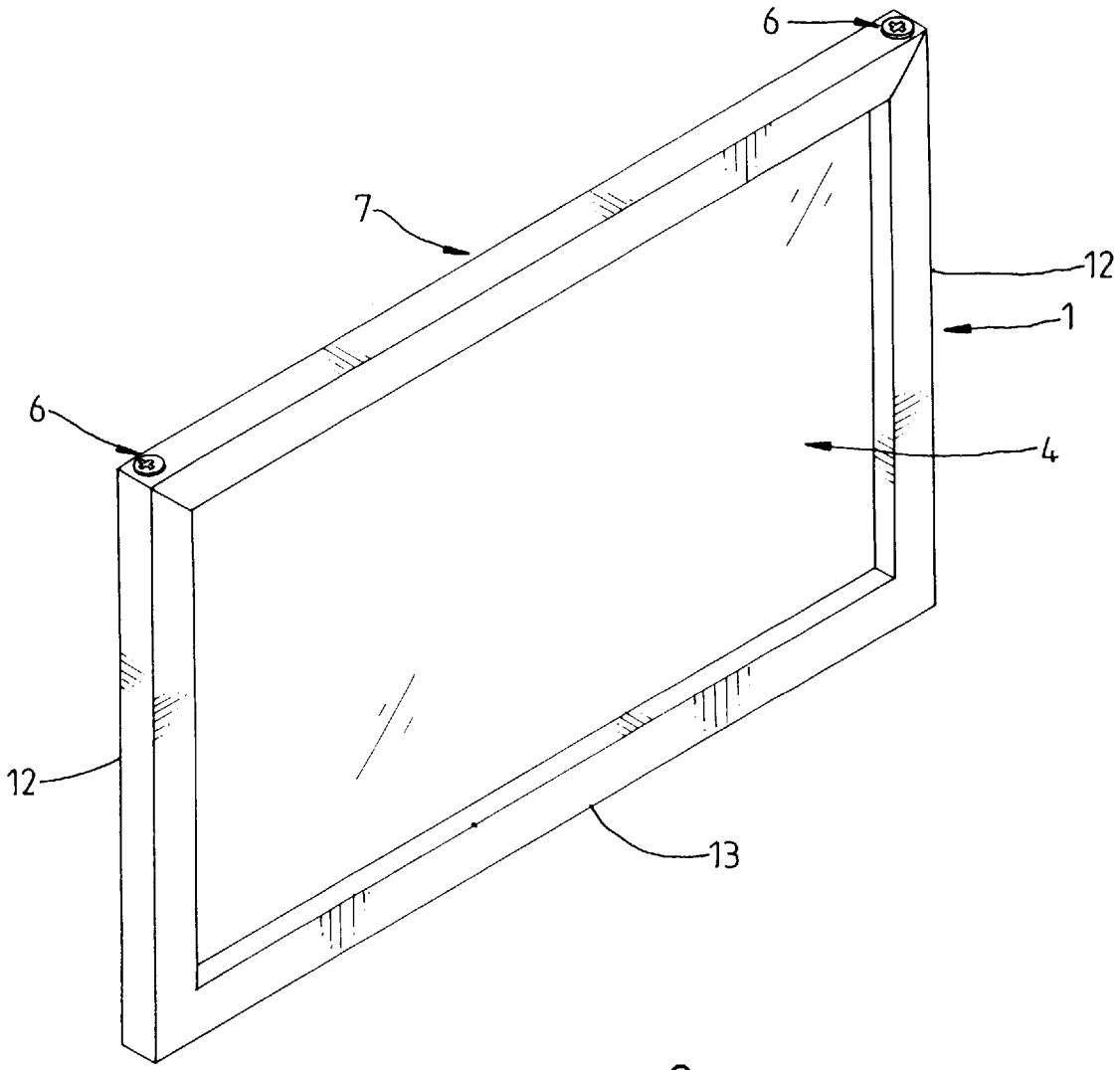
FIG. 2 is an elevational view of the present invention.
Figure 3:
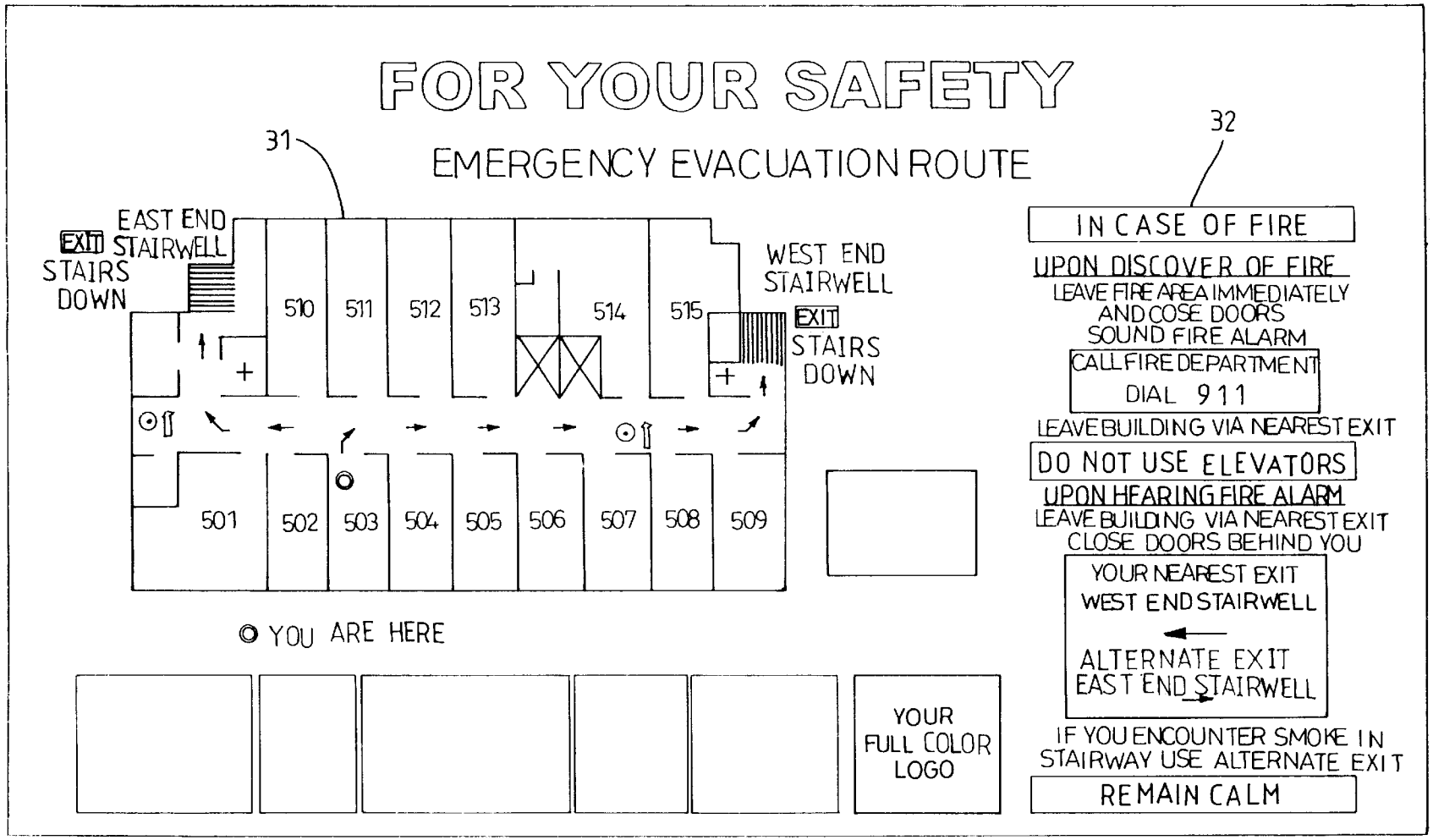
FIG. 3 illustrates a printing example of the mylar transparency.

Referring to FIGS. 2 and 3 and FIG. 1 again, the base frame 1 comprises a horizontal bottom wall 13, two vertical side walls 12 respectively perpendicularly extended from two distal ends of the horizontal bottom wall 13, a flat back mounting flange 11 extended along the vertical side walls 12 and the horizontal bottom wall 13 and defining therewith a substantially U-shaped mounting groove 14 for the mounting of the photoluminescent back drop 2, the mylar transparency 3 and the clear protective lens 4, a plurality of mounting holes 111 through the flat back mounting flange 11 through which screws 5 are inserted to fix the base frame 1 to a wall surface or door panel (not shown), and two vertical screw holes 121 respectively provided at the beveled top edge of each of the vertical side walls 12. The photoluminescent back drop 2, the mylar transparency 3 and the clear protective lens 4 are attached to one another and inserted into the U-shaped mounting groove 14 of the base frame 1 with the mylar transparency 3 sandwiched in between the photoluminescent back drop 2 and the clear protective lens 4. The mylar transparency 3 is printed with custom graphics including evacuation route graphics 31 and messages 32. FIG. 3 shows a printing example of the mylar transparency 3. The clear protective lens 4 can be a sheet of clear plastic material or plexiglass. The top frame 7 comprises two countersunk holes 71 at two distal ends thereof. After insertion of the photoluminescent back drop 2 with the mylar transparency 3 and the clear protective lens 4 into the U-shaped mounting groove 14 of the base frame 1, the top frame 7 is attached with the two beveled end edges thereof to the beveled top edge of each of the vertical side walls 12, and then two screws 6 are respectively inserted through the countersunk holes 71 of the top frame 7 and threaded into the vertical screw holes 121 of the base frame 1 to fixedly secure the top frame 7 and the base frame 1 together.

In case of fire, the evacuation route graphics 31 and messages 32 of the photoluminescent back drop 2 can still be well seen in the dark because of the illumination of the mylar transparency 3. When changing the graphics of the mylar transparency 3, remove the screws 6 from the top frame 7, and then remove the mylar transparency 3 for a replacement. According to the present invention, the printer of a computer system can print the evacuation route graphics 31 and the messages 32 on the mylar transparency 3. Therefore, the preparation of the mylar transparency 3 is simple, and the user can change the design of the mylar transparency 3 easily.

It is to be understood that the drawings are designed for purposes of illustration only, and are not intended for use as a definition of the limits and scope of the invention disclosed.

What is claimed is:

1. A photoluminescent evacuation route kit comprising:

a base frame, said base frame comprising a horizontal bottom wall, two parallel vertical side walls respectively perpendicularly extended from two distal ends of said horizontal bottom wall, said vertical side walls each having a beveled top edge, a flat back mounting flange extended along said vertical side walls and said horizontal bottom wall and defining therewith a substantially U-shaped mounting groove, a plurality of mounting holes through said flat back mounting flange for fastening to a wall surface or door panel by screws, and two vertical screw holes respectively provided at the beveled top edge of each of said vertical side walls;

a photoluminescent backdrop inserted into the U-shaped mounting groove of said base frame and supported on said flat back mounting flange;

a clear protective lens inserted into the U-shaped mounting groove of said base frame;

a transparency inserted into the U-shaped mounting groove of said base frame and sandwiched in between said photoluminescent back drop and said clear protective lens, said transparency having graphics of emergency evacuation route and messages printed thereon; and a top frame fastened to said base frame to hold said photoluminescent back drop, said transparency and said clear protective lens in the U-shaped mounting groove of said base frame, said top frame comprising two beveled end edges respectively fitted over the beveled top edge of each of said vertical side walls of said base frame, and two countersunk holes respectively fastened to the vertical screw holes of said base frame by a respective screw.

2. The photoluminescent evacuation route kit of claim 1 wherein said clear protective lens is made of plexiglass.

3. The photoluminescent evacuation route kit of claim 1 wherein said clear protective lens is made of plastic material.

* * * * *